US005653436A

United States Patent [19]

Zouzoulas

[11] Patent Number: 5,653,436

[45] Date of Patent: Aug. 5, 1997

[54] SECURE CURRENCY CASSETTE WITH A CONTAINER WITHIN A CONTAINER CONSTRUCTION

[75] Inventor: John Zouzoulas, deceased, late of West Chester, Pa., by Helen Zouzoulas, executrix

[73] Assignee: Mars, Incorporated, McLean, Va.

[21] Appl. No.: 427,983

[22] Filed: Apr. 21, 1995

Related U.S. Application Data

[63] Continuation of Ser. No. 179,110, Jan. 10, 1994, abandoned.

[51] Int. Cl.[6] ..... B65H 29/38

[52] U.S. Cl. ..... 271/177; 271/180; 271/181; 271/163

[58] Field of Search ..... 271/177, 180, 271/181, 163, 162, 145, 207; 221/197, 198, 287; 232/43.2, 15, 16, 1 D, 31, 32; 109/45, 47

[56] References Cited

U.S. PATENT DOCUMENTS

| | | | |
|---|---|---|---|
| 901,778 | 10/1908 | Bucknam . | |
| 1,394,941 | 10/1921 | Ruebsamen et al. . | |
| 2,973,139 | 2/1961 | Leone et al. . | |
| 3,016,185 | 1/1962 | Osborne . | |
| 3,773,252 | 11/1973 | Jensen . | |
| 3,966,116 | 6/1976 | Dominick et al. . | |
| 4,050,562 | 9/1977 | Schwippert et al. . | |
| 4,136,262 | 1/1979 | Clark, Jr. . | |
| 4,313,601 | 2/1982 | Graef et al. . | |
| 4,341,100 | 7/1982 | Kohlhage . | |
| 4,380,316 | 4/1983 | Glinka et al. . | |
| 4,434,931 | 3/1984 | Hunt et al. . | |
| 4,471,905 | 9/1984 | Sloma et al. . | |
| 4,628,194 | 12/1986 | Dobbins et al. | 235/379 |
| 4,638,746 | 1/1987 | Ishigure | 232/43.2 X |
| 4,648,327 | 3/1987 | Toth et al. . | |
| 4,678,072 | 7/1987 | Kobayashi et al. . | |
| 4,722,519 | 2/1988 | Zouzoulas | 271/188 |
| 4,765,607 | 8/1988 | Zouzoulas | 271/177 |
| 4,775,824 | 10/1988 | Barnes et al. | 318/567 |
| 4,807,736 | 2/1989 | Kondo et al. . | |
| 4,840,368 | 6/1989 | Uehara . | |
| 4,854,247 | 8/1989 | Sciortino et al. . | |
| 4,877,179 | 10/1989 | Baker et al. . | |
| 4,949,901 | 8/1990 | Harris . | |
| 4,976,346 | 12/1990 | Juds et al. . | |
| 4,977,583 | 12/1990 | Gorgone . | |
| 4,986,826 | 1/1991 | Bernier . | |
| 4,997,128 | 3/1991 | Suris . | |
| 5,014,857 | 5/1991 | Kondo . | |
| 5,076,413 | 12/1991 | Davila et al. . | |
| 5,100,022 | 3/1992 | Fukudome et al. | 221/198 |
| 5,209,335 | 5/1993 | Shuren et al. . | |
| 5,209,395 | 5/1993 | Zouzoulas et al. | 232/15 |
| 5,222,584 | 6/1993 | Zouzoulas | 194/207 |
| 5,251,738 | 10/1993 | Dabrowski | 271/181 X |

FOREIGN PATENT DOCUMENTS

| | | |
|---|---|---|
| 2410998 | 9/1975 | Germany . |
| 3304332 | 8/1984 | Germany . |
| 2236143 | 3/1991 | United Kingdom . |

*Primary Examiner*—David H. Bollinger
*Attorney, Agent, or Firm*—Fish & Richardson P.C.

[57] ABSTRACT

A more readily manufacturable and repairable lockable removable currency storage cassette is described. The cassette employ a container within a container or box within a box construction in which an outer box provides tamper evident security and a removable inner box contains operating components which may require service or repair.

14 Claims, 14 Drawing Sheets

SECURE CURRENCY CASSETTE WITH A CONTAINER WITHIN A CONTAINER CONSTRUCTION

This is a continuation of application Ser. No. 08/179,110 filed on Jan. 10, 1994, now abandoned.

FIELD OF THE INVENTION

The present invention relates generally to improvements in method and apparatus for the validation and secure handling of currency. More particularly, the present invention addresses security concerns which are related to currency validation and handling faced in industries, such as the gaming or vending industries.

BACKGROUND OF THE INVENTION

A variety of bill or currency validation and stacking techniques are known in the prior art, including the following U.S. Pat. No. 4,628,194 (METHOD AND APPARATUS FOR CURRENCY VALIDATION), U.S. Pat. No. 4,722,519 (STACKER APPARATUS), U.S. Pat. No. 4,765,607 (STACKER APPARATUS), U.S. Pat. No. 4,775,824 (MOTOR CONTROL FOR BANKNOTE HANDLING APPARATUS), U.S. Pat. No. 5,209,395 (METHOD AND APPARATUS FOR A LOCKABLE, REMOVABLE CASSETTE, FOR SECURELY STORING CURRENCY), U.S. Pat. No. 5,222,584 (CURRENCY VALIDATOR) AND U.S. Pat. No. 5,209,335 (SECURITY ARRANGEMENT FOR USE WITH A LOCKABLE, REMOVABLE CASSETTE), all of which are assigned to the assignee of the present invention and incorporated by reference herein.

In applications where security and accountability are of particular concern, such as in gaming industry and in certain fields of the vending industry, a number of features are particularly desirable. For example, easy front access without the use of tools to clear any currency jams or to clean the unit is desirable to ease service and minimize the downtime of units which may typically be employed in slot machines. Such easy front access is particularly advantageous for slot machines because they are typically arranged side by side and back to back or alternatively are placed side by side with their backs against a wall.

A cash or currency storage cassette should provide tamper evident security so that while a locked cassette may not survive a crowbar, torch, or the like, currency cannot be removed by an unauthorized person without telltale evidence of tampering. The cassette should also be readily lockable and removable, and upon its removal, no access to the currency validation or other electronics should be provided. Similarly, removal of the currency validator should not allow access to any money stored in the lockable removable currency cassette.

When the cassette is removed, the currency validator should not accept currency. Thus, it is highly desirable to be able to sense removal of the currency cassette. In addition, the currency cassette should have as few electronic or electrical components as possible to prevent tampering by persons charged with collecting the currency cassette, and should be robust in its design so as to include no delicate mechanical components which could be readily tampered with or which would necessitate frequent service.

Further, an accurate currency count must be maintained. To this end, each time a piece of currency is pushed into or stored in the currency cassette it must be counted so that any discrepancies between the currency found in the cassette when it is opened by an authorized person, and the currency count maintained by a slot machine with which the cassette is used, may be readily detected.

One existing product employed in slot machines attempts to provide many of the above desirable features. This product, however, includes a gear driven currency transport arrangement which is susceptible to poor gear alignment. The currency transport drive used in its currency cassette also drives its currency pusher arrangement. As a result, a gear which drives the currency cassette transport may not rotate to achieve alignment as readily as desirable. Also, the gear teeth which must mesh are fairly blunt to provide optimal torque consistent with standard gear tooth design principles; however, the bluntness of these teeth is such that the possibility of tooth head against tooth head interference is increased. When such interference occurs, jiggling and manipulation must be resorted to in an attempt to achieve proper meshing and alignment. Alternatively, if one attempts to force the teeth to mesh, damage to the unit may occur.

This product provides a lockable removable cassette made out of metal which is riveted or welded in an effort to provide tamper evident security. This existing product, however, has a relatively complex structure which tends to result in higher cost of manufacture and a higher cost of repair.

Further, this product includes an optical source and sensor to detect stacking of currency in the cassette and an electronic connecting plug that must be connected to a utility plug in the currency validation portion of the unit. This sensing arrangement reduces the maximum available width of cassette which can fit within a given outer form factor. This limitation prevents widening the cassette adapted to accept U.S. currency, for example, to accept both U.S. currency and a wider currency such as Canadian currency for example.

This product also employs two separately driven currency transports requiring two power supplies. The two separate drives may not be perfectly synchronized resulting in currency buckling or jamming.

A secure product which is easier and less expensive to manufacture, as well as easier to service or repair, is highly desirable.

SUMMARY OF THE INVENTION

The present invention provides the desirable features discussed above without the problems inherent in the existing approach also discussed above. As more fully addressed in the drawings, detailed description and claims, the present invention provides a mechanically simpler and an electronically more secure product.

By way of example, in a presently preferred embodiment of the invention, only one motor, one power supply and one drive transport are employed to transport currency from its entry into the currency validator to a ready to be stacked position. A superior gear alignment arrangement is also provided. In addition, a mechanical sensing arm is used to sense movement of a cassette pusher plate thereby reliably detecting the pushing of currency into the cassette without the use of any electronic or electrical components in the cassette.

Also, a simple, but mechanically robust pushing arrangement is provided. This simple external mechanical pusher drive arrangement is employed so that the lockable removable cassette is externally driven thereby reducing the possibilities of a cassette failure or malfunction requiring repair. In addition, a faster accept cycle may be achieved.

Further, by eliminating an optical sensor located in the prior art cassette, the interior of the currency cassette of the present invention can be widened while still fitting within the same overall form factor. This improved usage of the interior of the cassette facilitates the possible acceptance of wider currency, such as Canadian currency, and narrower currency, such as United States currency, in the same cassette.

Finally, a box within a box design is employed for the currency cassette to facilitate its manufacture, service and the easy modular replacement of any moving parts. In this design, an inner box which contains essentially all of the moving parts is employed in conjunction with an outer box which may be a simple welded or riveted metal box. In one typical repair utilizing the advantages of the present invention, a damaged inner box can be simply removed and replaced. The overall cassette is then returned to service and repairs can be performed on the damaged inner box. In contrast, a unitary construction as employed by the above mentioned existing approach requires opening an outer metal case of the cassette, which has been specifically designed to make access difficult, to gain access to the internal works. Once the repair has been made the metal case must be closed again.

Further features of the invention, its nature and various advantages will become more apparent from the accompanying drawings and following detailed description of the invention.

DETAILED DESCRIPTION

Certain major aspects of the present invention are discussed below in the following order. First, the overall mechanical arrangement of components, their interrelationship and connection, and specific details as to certain components are discussed in conjunction with FIGS. 1–6. Second, details of currency transport from an entryway to a prestacking position are discussed in conjunction with FIGS. 7–12. Third, details pertaining to stacking, as well as the sensing of a stacking operation and the sensing of cassette placement or removal, are addressed in conjunction with FIGS. 13–16. Other various aspects of the present invention are discussed as appropriate throughout the disclosure.

Figure 1:
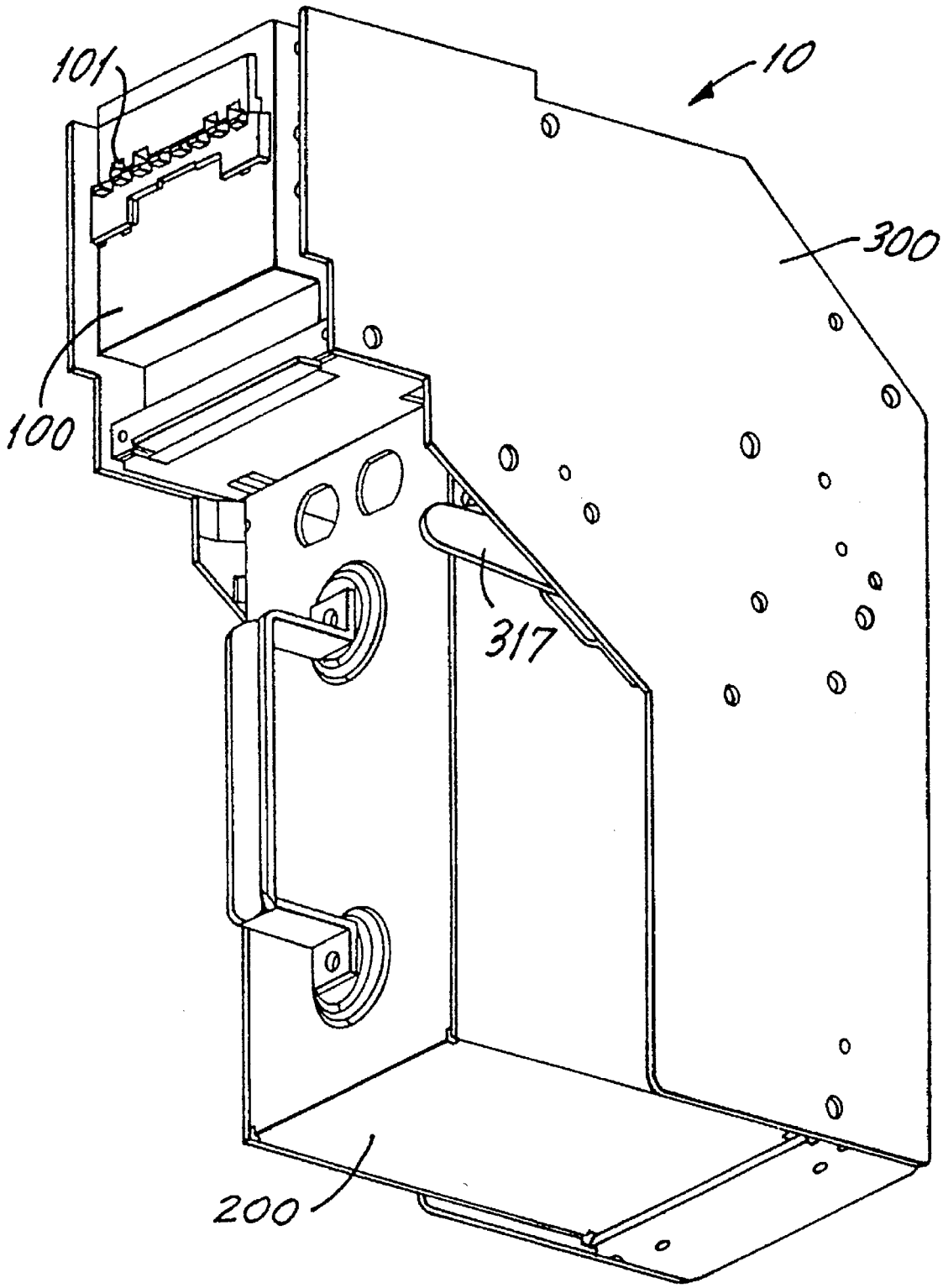
FIG. 1 is an overall block diagram of a currency validator and stacker according to one embodiment of the present invention showing the interrelationship of a bill validator and transport unit, a mounting chassis and a lockable removable currency cassette.

FIG. 1 illustrates a currency validator and stacker unit 10 according to one embodiment of the present invention. The unit 10 has three major subcomponents: a currency validator and transport unit 100, a lockable removable currency cassette 200 and a mounting chassis 300. Unit 10 is particularly well suited to a high security environment such as the gaming industry or certain fields of the vending industry. One presently preferred use for the validator and stacker unit 10 is as a validator in a U.S. one, five, ten, twenty, fifty or one hundred dollar slot machine. Ease of service, reliability and fraud resistance are hallmarks of the present invention.

Figures 2, 2A:
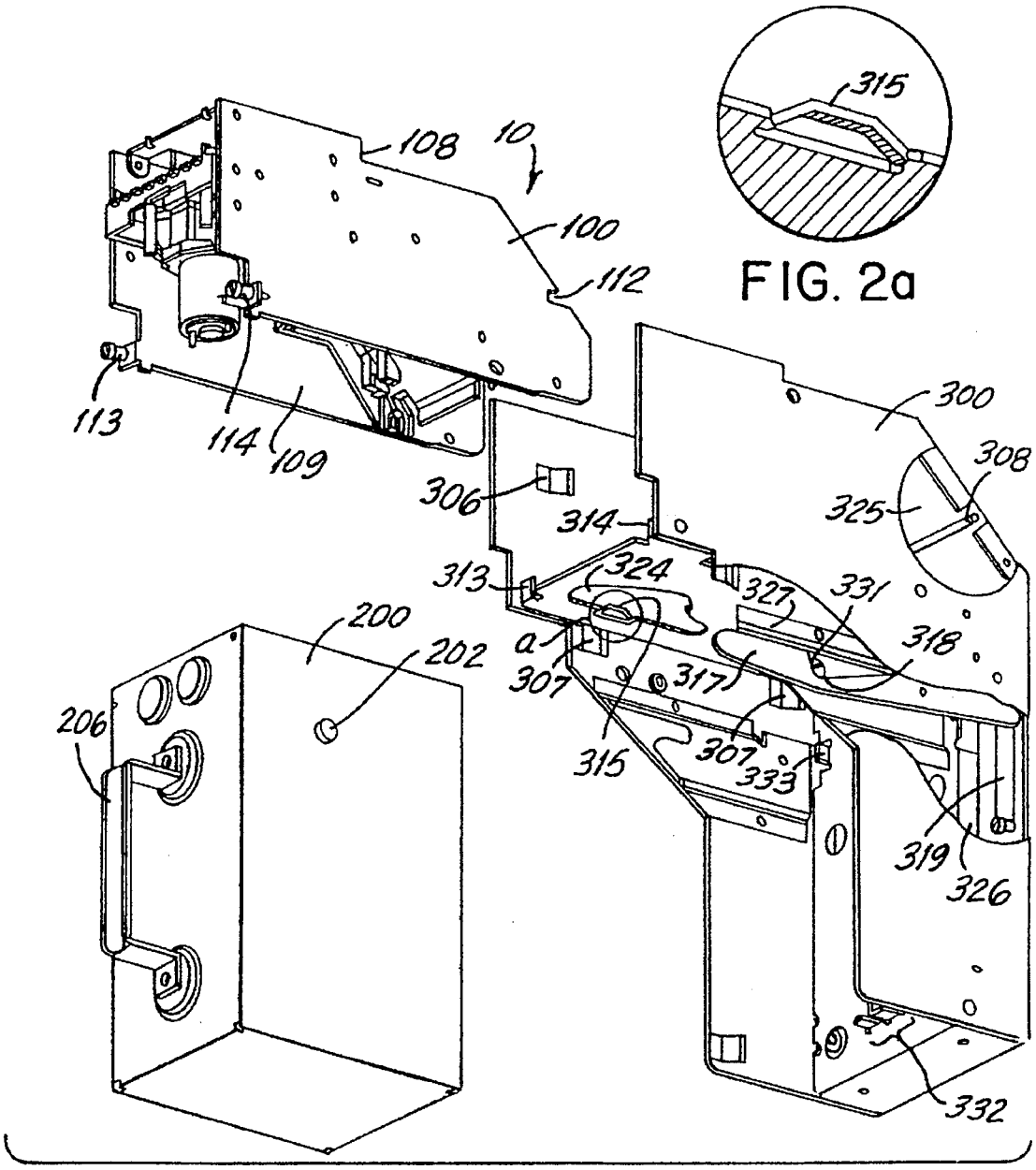
FIG. 2 is an exploded block diagram showing further details of the interrelationship of the bill validator and transport unit, the mounting chassis and the lockable removable currency cassette of FIG. 1.
FIG. 2*a* is an enlarged view of region "a" of FIG. 2, showing a guide rail for guiding the bill validator and transport unit into the mounting chassis.

As illustrated in the exploded view of unit 10 shown in FIG. 2, the currency validator and transport unit 100 and the cassette 200 are preferably readily slidably removable from the front of the unit 10. Because typical usage of the unit 10 may necessitate frequent removal and replacement of the cassette 200, as well as less frequent removal and cleaning or repair of the validator and transport unit 100, it is important that proper realignment of the components 100, 200 and 300 with respect to one another be readily and consistently achieved without repeated trial and error or use of undue force.

The currency validator and transport unit 100 has side plates 108 and 109 providing support for components located therebetween. The bottom edges of the side plates 108 and 109 are guided by one or more validator guide rails, such as guide rail 315 shown in the breakaway view 324 of the mounting chassis 300. FIG. 2*a* is an enlarged view of the guide rail 315 of FIG. 2. Guiding of the validator and transport unit 100 is further aided by one or more leaf springs, such as spring 306, which provide both tension and centering while the currency validator and transport unit 100 is being slidably placed in or removed from the mounting chassis 300.

A locating rod 308, as shown in a cutaway view 325 through a wall of the mounting chassis 300, is used to correctly position the currency validator and transport unit 100 by engaging guide slots 112 in the unit 100. Finally, captive thumb screws 113 and 114 are used to lock the currency validator and transport unit 100 to the mounting chassis 300 through tapped holes 313 and 314. Alternatively, quarter turn fasteners may be used.

In its presently preferred construction, the validator and transport unit 100 may be removed by an authorized person from the front of the unit 10 without the use of any tools. Upon its removal, no ready access is provided to any currency stored in the cassette 200.

The cassette 200 is also preferably designed to be removed by an authorized person without tools from the front of the unit 10, and upon its removal, no ready access to validation or other electronics is provided. Cassette 200 is inserted into the mounting chassis 300 by positioning a guide pin 202 on a spring biased release lever 317. The release lever 317 extends out of the chassis 300, as shown in FIG. 1. Leaf springs 307 provide both tension and centering while the cassette 200 is pushed into the chassis 300. As the cassette 200 is guided into chassis 300, it forces the release lever 317 down until the guide pin 202 engages a stop position 318 on the release lever 317. The spring 319 shown in a cutaway view 326 through the side wall of the chassis 300 exerts a return force on the release lever 317 causing a positive audible snap when correctly positioned. The stop position 318 includes a biasing angle 331 to maintain force against the pin 202 to compensate for manufacturing tolerances. The rear of the cassette 200, not shown, has slots which mate with horizontal positioning tabs 332 and vertical positioning tabs 333 located on a rear wall of the mounting chassis 300.

To remove the cassette 200 from the mounting chassis 300, the portion of the release lever 317 which extends out of the chassis, as shown in FIG. 1, is pressed in a downward direction to overcome the force of the spring 319 while the cassette is withdrawn using handle 206.

Figure 3:
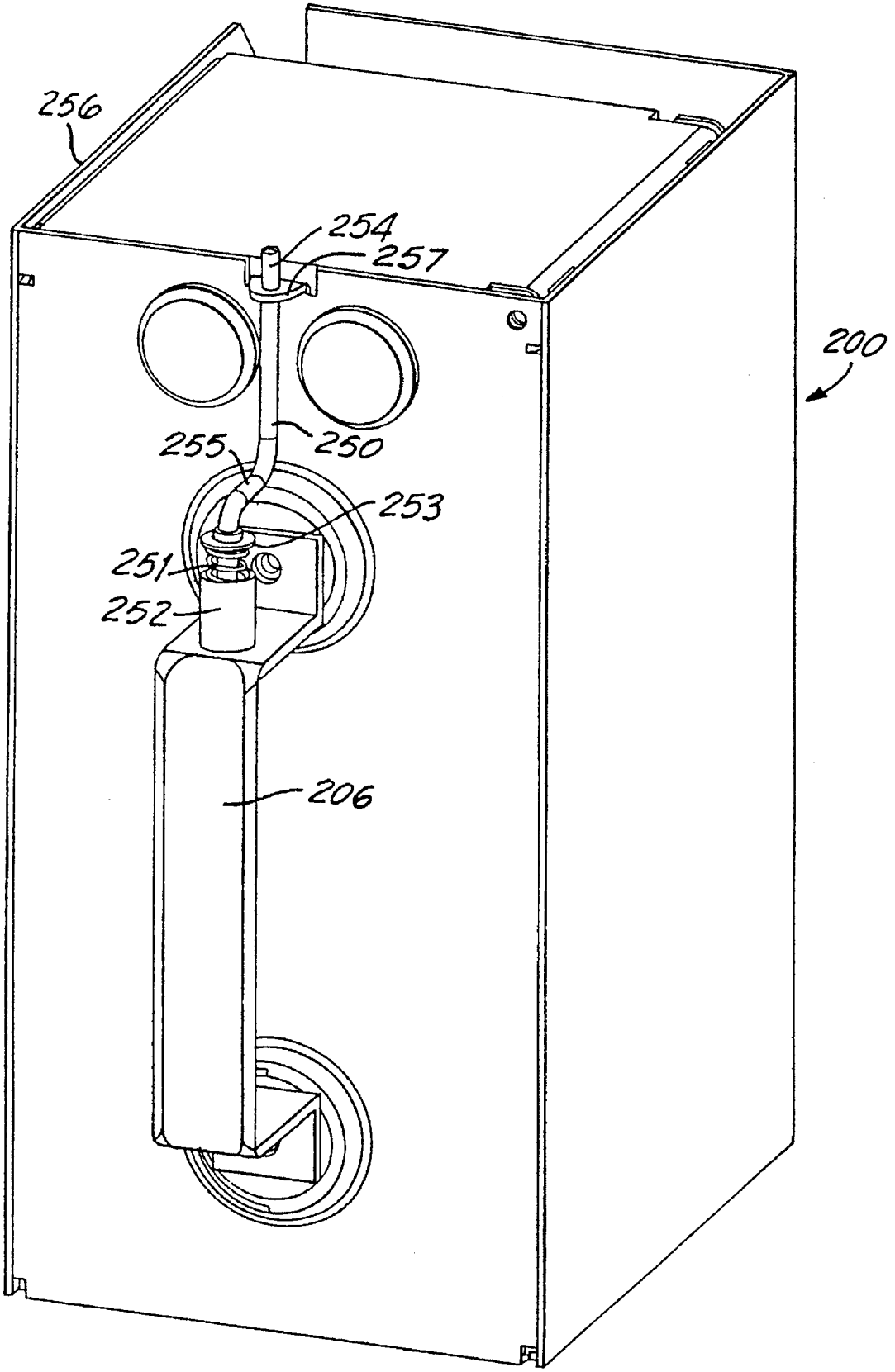
FIG. 3 is a perspective view of an alternate engaging arrangement suitable for use in the cassette of FIG. 1.

FIG. 3 illustrates an alternate embodiment for engaging the cassette 200 and the chassis 300. This arrangement of FIG. 3 eliminates the need for the release lever 317 and the spring 319 of FIG. 2. In their place, a hole is included in the chassis 300. This hole is positioned so as to be aligned with a post or end 254 shown in FIG. 3 when the cassette 200 is properly positioned with respect to the chassis 300. A latch 250 is normally biased by a spring 251 so that the end 254 of the latch 250 protrudes above the top surface 256 of the cassette 200. The end 254 of latch 250 will engage the above mentioned opening in the chassis 300. The latch 250 also has a surface 255 which when depressed against the force of the spring 251 will allow the latch 250 to lower until a stop 253 reaches a post 252. The amount of movement is such as to allow the end 254 to disengage the chassis 300, while remaining captured by a retainer 257. An advantage of the configuration of FIG. 3 is that it allows the disengagement of the cassette 200 to be achieved with one hand. As the handle 206 is held in one's hand, one's thumb is correctly positioned to depress the surface 255 releasing the latch end 254. Likewise, upon inserting the cassette, the latch surface 255 may be readily depressed until the end 254 of latch 250 is aligned with the opening, and then it can be released so that the cassette 200 is again engaged with the chassis 300.

Figure 4:
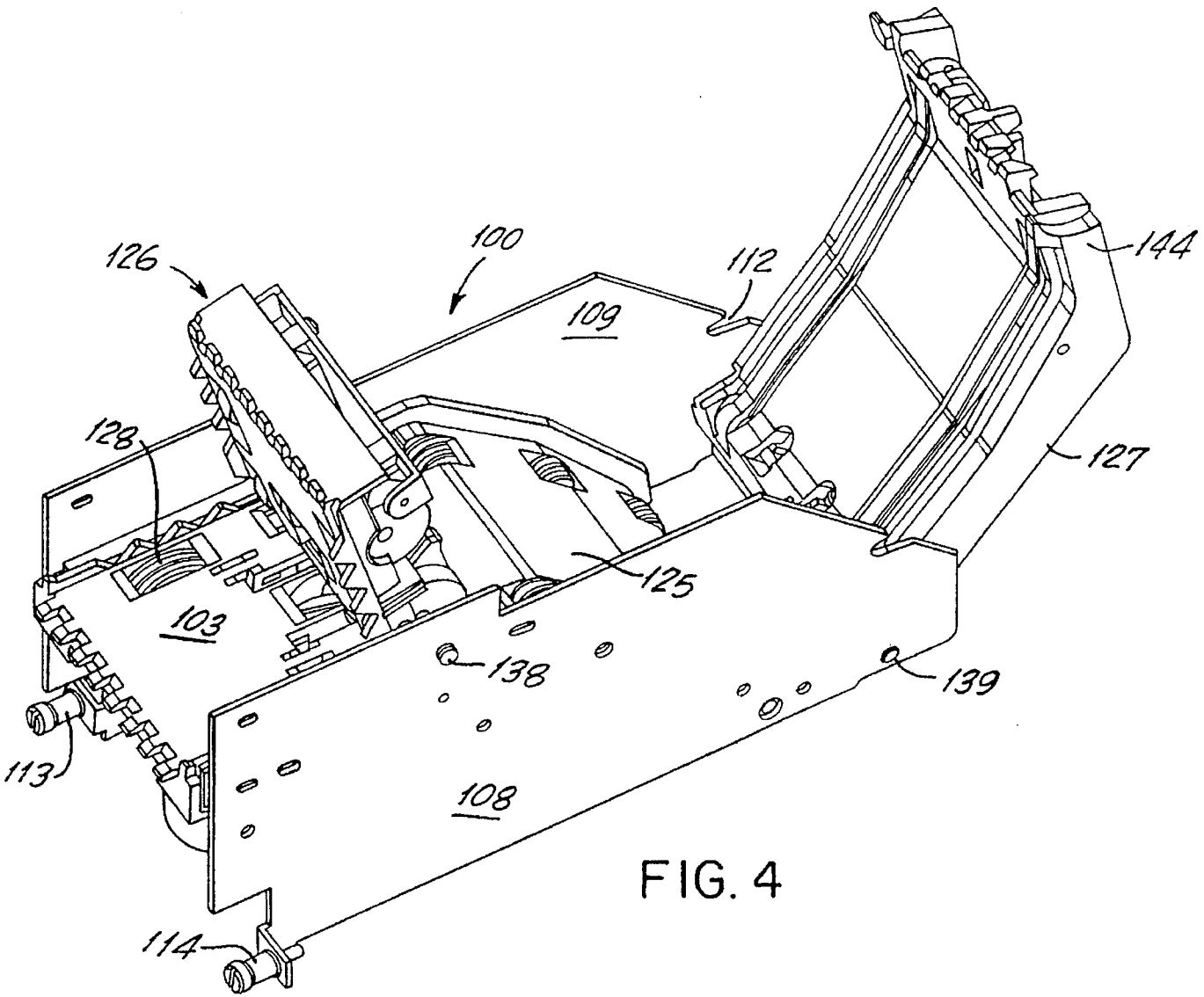
FIG. 4 is a perspective drawing of the bill validator and transport unit of FIGS. 1 and 2.

FIG. 4 is a perspective drawing of the currency validator and transport unit 100 of FIGS. 1 and 2, and it illustrates the unit 100 in greater detail. In particular, FIG. 4 illustrates the hinging of the unit 100 for easy maintenance.

Currency travels through unit 100 along a currency transport or bill path 103. As shown in FIG. 4, the currency transport path 103 is readily accessible for cleaning the maintenance.

The currency transport path 103 is formed by three subassemblies. A transport base 125 forms the bottom portion of the currency transport path 103. The top portion is formed by a recognition assembly 126 and a guide assembly 127. FIG. 4 shows both the recognition assembly 126 and the guide assembly 127 in their open or bill path accessible position. The recognition assembly 126 is pivotally mounted to the side plates 108 and 109 on a pivot rod 138. Similarly, the guide assembly 127 is pivotally mounted to the side plates 108 and 109 on a pivot 139.

The guide assembly 127 has a forward profile 144 which when in the normal or closed position, not shown, is held captive by the closed recognition assembly 126. The recognition assembly 126 is held closed by capture screws or spring clips, not shown. To close the unit 100, the guide assembly 127 is first rotated toward the transport base 125 about the pivot 139. The recognition assembly 126 is then rotated toward the transport base 125 about pivot 138 thereby capturing and locking in place the guide assembly. The recognition assembly 126 is then fastened in place with the capture screws or spring clips.

Figure 5:
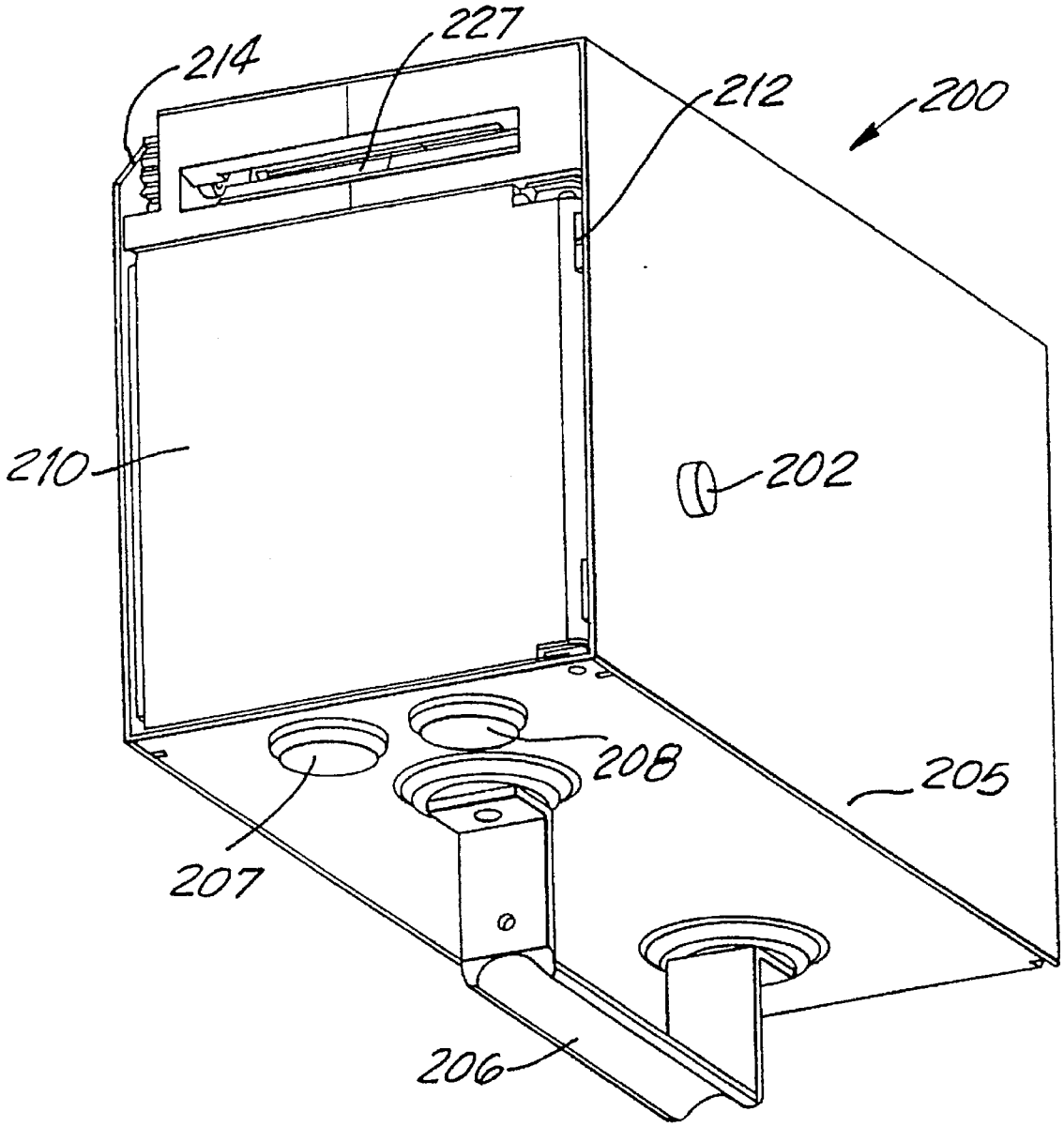
FIG. 5 is a perspective drawing of the lockable removable cassette of FIGS. 1 and 2.

FIG. 5 illustrates further details of the cassette 200. As shown in FIG. 5, in a presently preferred embodiment, the cassette 200 consists of a sealed metal outer frame 205 which may be sealed by rivets, welding or any other suitable secure or tamper evident method of closure. Alternatively, the outer frame 205 could be made of a durable molded plastic such as a polycarbonate. The only possible access to the cassette 200 without damaging the outer frame 205 is through a narrow slot or cassette opening 227 or locks 207, 208. As discussed further in connection with FIG. 7, currency passing from the validator and transport unit 100 to the cassette 200 enters the cassette 200 through the opening 227; however, that opening is sufficiently small and the currency transporting components inside the cassette 200 are arranged such that no ready access to currency stacked within the cassette 200 is provided.

Attached at one end of the cassette 200 is the handle 206. The handle 206 is used to slidably remove the cassette 200 from the unit 10, as discussed above, when it is desired to remove the currency from the cassette. At the same end as the handle 206, a cassette according to the present invention typically includes one or more locks for locking the cassette 200 to prevent unauthorized access to the currency in the cassette 200. As shown in FIG. 5, the cassette 200 includes the two locks 207 and 208. When the locks 207 and 208 are unlocked using keys, a lid 210 at the top of the cassette 200 can be swung open about hinge 212, (shown in greater detail in FIG. 6) so that the currency in the cassette 200 can be readily removed. The lid 210 can then be closed, the locks 207, 208 can be locked, and the cassette 200 can be returned to service by slidably inserting it back into any unit, such as the unit 10, which needs an empty cassette. Other features of the cassette 200, illustrated in FIG. 5, include a gear 214 which is driven from a motor or drive 105 (shown in FIG. 7) in the validator and transport unit 100 to drive a piece of currency from the transport unit 100, through opening 227 and into its pre-stacking position 201, as will be discussed further below.

Figure 6:
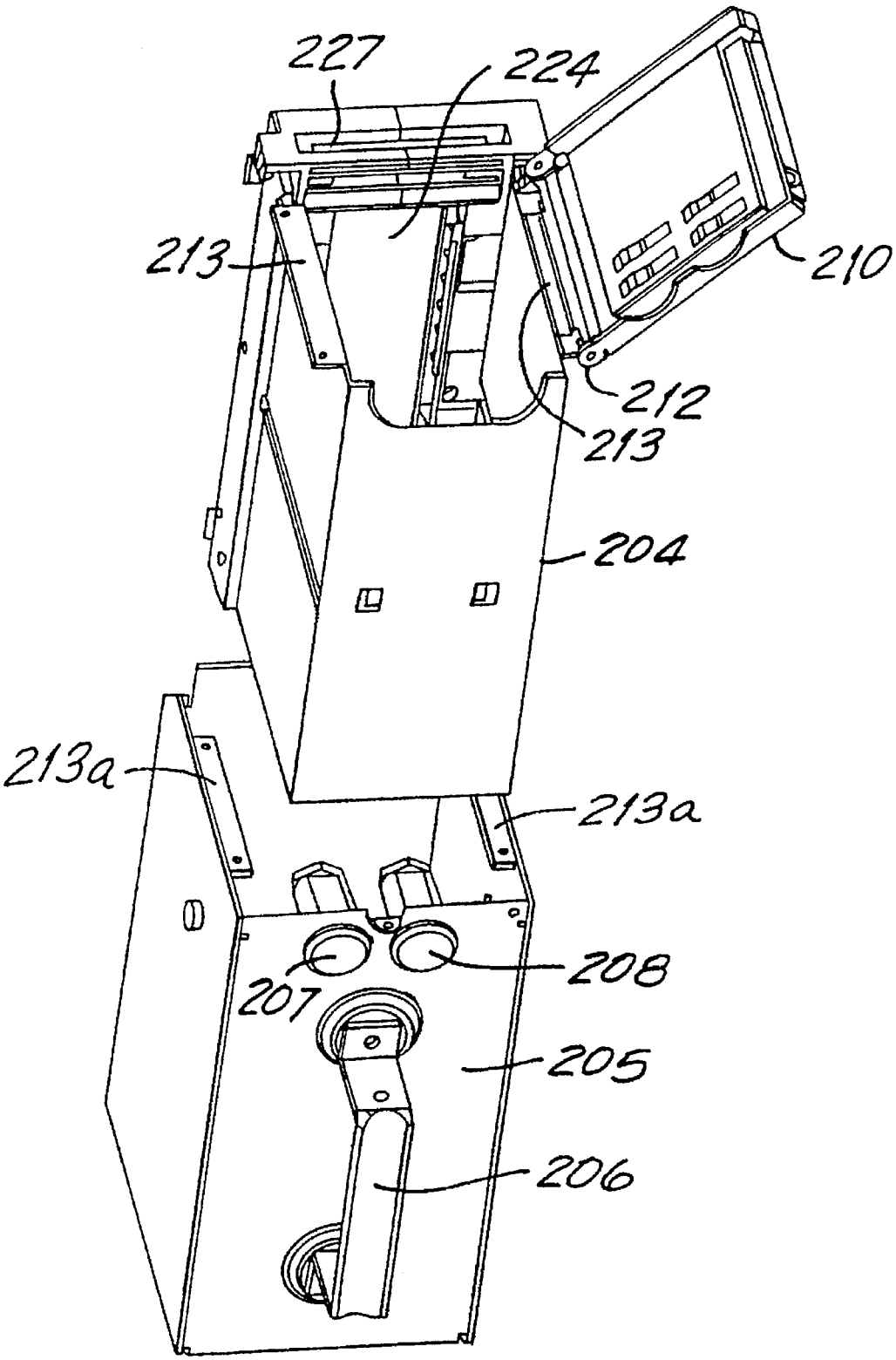
FIG. 6 is a perspective drawing illustrating a box within a box construction for the cassette according to the present invention.

FIG. 6 illustrates the presently preferred construction of cassette 200. The outer frame 205 is substantially a shell or box inclusive of the handle 206 and locks 207 and 208. Within this shell is an inner assembly or box 204. The components of the cassette 200 are primarily housed in the inner assembly 204 which, because it is protected by outer frame 205, may be designed for ease of manufacture. With the exception of the lid 210 and its hinging and mounting, such as mounting surfaces 213, the inner assembly 204 can contain all or mostly plastic as the material of choice is not constrained by the need for security. The outer frame 205 provides the security and inaccessibility to the bills to be housed therein. The inner assembly 204 is inserted into the outer frame 205 as illustrated, from the top. Access to the mounting surfaces 213 and the inside of inner assembly 204 is only available when the lid 210 is unlocked.

To remove the inner assembly 204, the locks 207 and 208 are unlocked. Then, the locks 207 and 208 are removed from the outer frame 205 by unscrewing them. The lid 210 is opened providing access to the mounting surfaces 213. The connection mechanisms, such as threaded screws (not shown) for connecting the mounting surfaces 213 to matching surfaces 213*a* of the outer frame 205 are removed. Finally, the inner assembly 204 can be slid out of the outer frame 205.

If the components of inner assembly 204 are jammed, they may be readily serviced on the spot. If something is broken or the inner assembly 204 is otherwise damaged, a replacement assembly can be inserted and the damaged inner assembly 204 can be taken away for service.

While FIG. 6 shows the inner assembly 204 as being somewhat narrower than the width between the interior walls of the outer frame 205, the inner assembly 204 could be readily widened to allow the stacking of wider currency, such as Canadian currency, for example.

Figure 7:
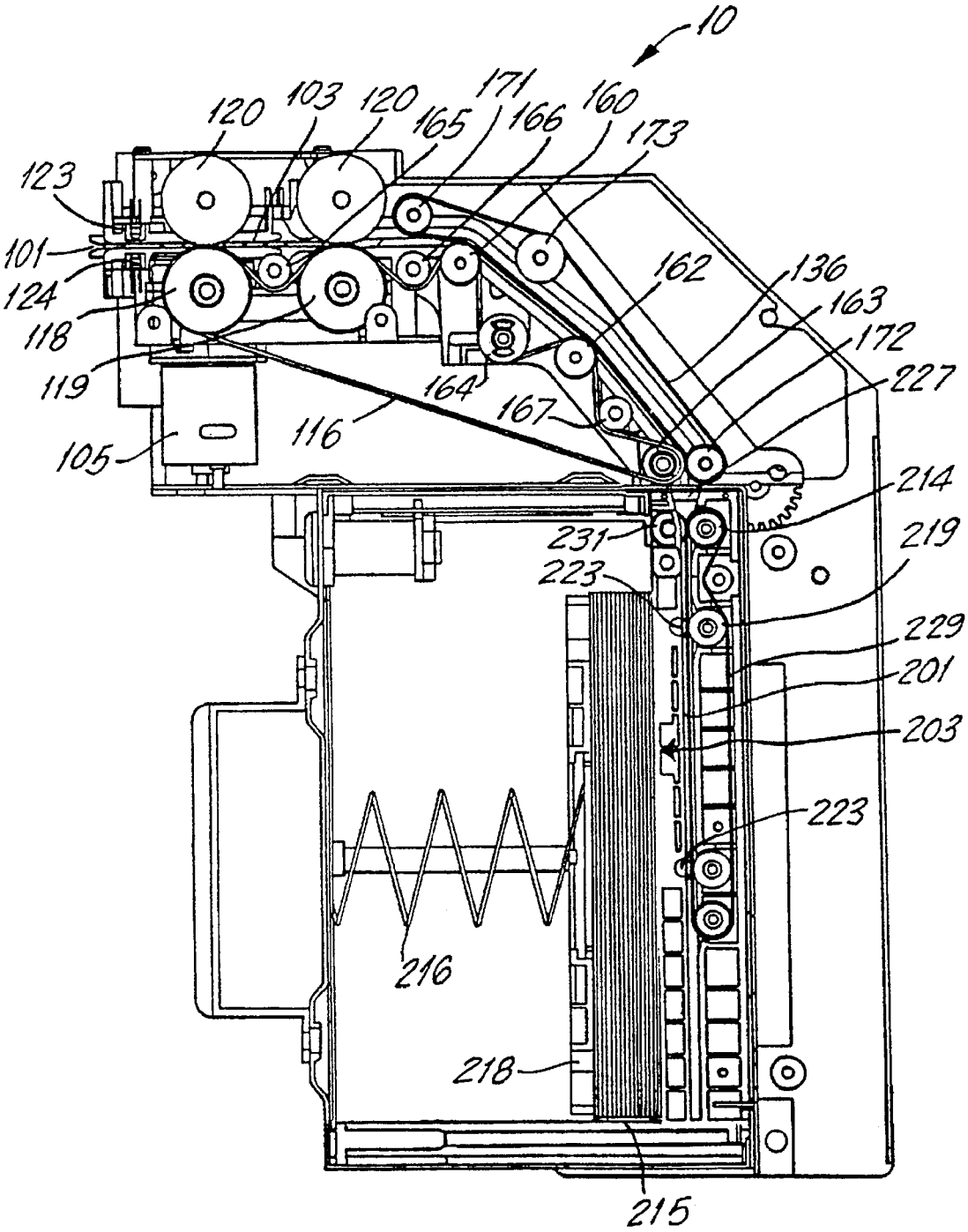
FIG. 7 is a detailed side view of the overall apparatus of FIG. 1, absent an interrupt arm and an actuating fork, for purposes of more clearly illustrating currency travel through the apparatus of FIG. 1.

As best seen in FIG. 7, the overall operation of the unit 10 with respect to currency transport will typically proceed as follows, a customer will insert a genuine piece of currency, such as a U.S. dollar bill, into an insert slot 101, and the currency will be transported along the currency transport path 103. As the currency is transported, it will be checked for authenticity or validity. If recognized as valid and to be accepted by a host controller, the currency will be further driven to a prestacking position 201 in the cassette 200. In its pre-stacked position 201, the piece of currency is held between rollers 219 and spherical balls 223. On one side (the right-hand side as seen in FIG. 7) of the currency there is a pusher or slider plate 217. (Shown in FIG. 13) On the other side (the left-hand side) of the pre-stacked currency is a window 224 (shown in FIG. 6), through which the bill can be pushed. The currency will then be pushed in the direction of arrow 203 into the cassette 200. Beyond the window 224, a spring 216 holds the currency in a stacked position and serves to appropriately bias a back or pressure plate 218. The currency will then be securely stored in the stacked position until removed by authorized personnel.

If the unit 100 becomes jammed, requires routine cleaning and maintenance, or otherwise requires servicing, a first authorized person slides out the unit 100, opens the unit 100 (as illustrated in FIG. 4) and performs the required task. Removal of the unit 100 will not provide the person authorized to service the unit 100 with access to the currency stored in the cassette 200.

When the cassette 200 is full, or at some other time determined by the owner of the unit 10, typically a second authorized service person will remove the cassette 200 and deliver it to a central location so that the currency in the cassette 200 can be removed and counted by yet a third authorized person. Typically, when the cassette 200 is removed, it is replaced by an empty replacement cassette so that operation of the unit 10 is not unduly interrupted. Removal of the cassette 200 does not provide the person authorized to remove the cassette 200 with access to the electronics of the unit 100. In addition, as discussed in greater detail below, if no cassette is present, that condition is sensed, and the host controller of the unit 10 will not allow unit 10 to operate to accept currency.

Figure 8:
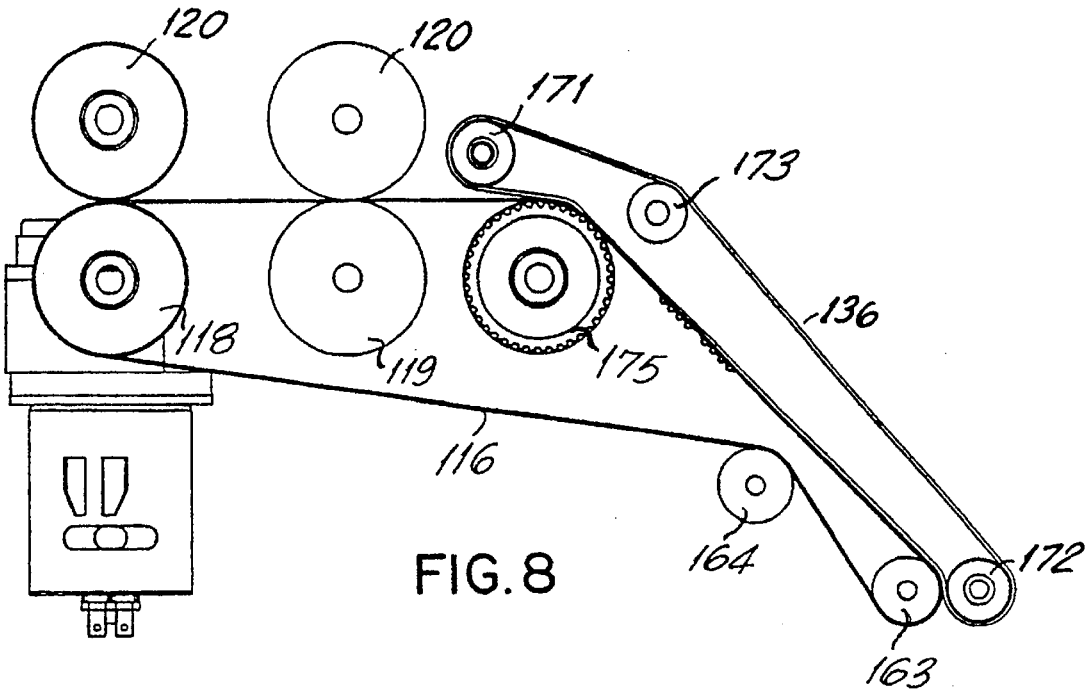
FIG. 8 is a detailed view of an alternate pulley/belt currency transport arrangement for use in the bill validator and transport unit of FIG. 1.
Figure 9:
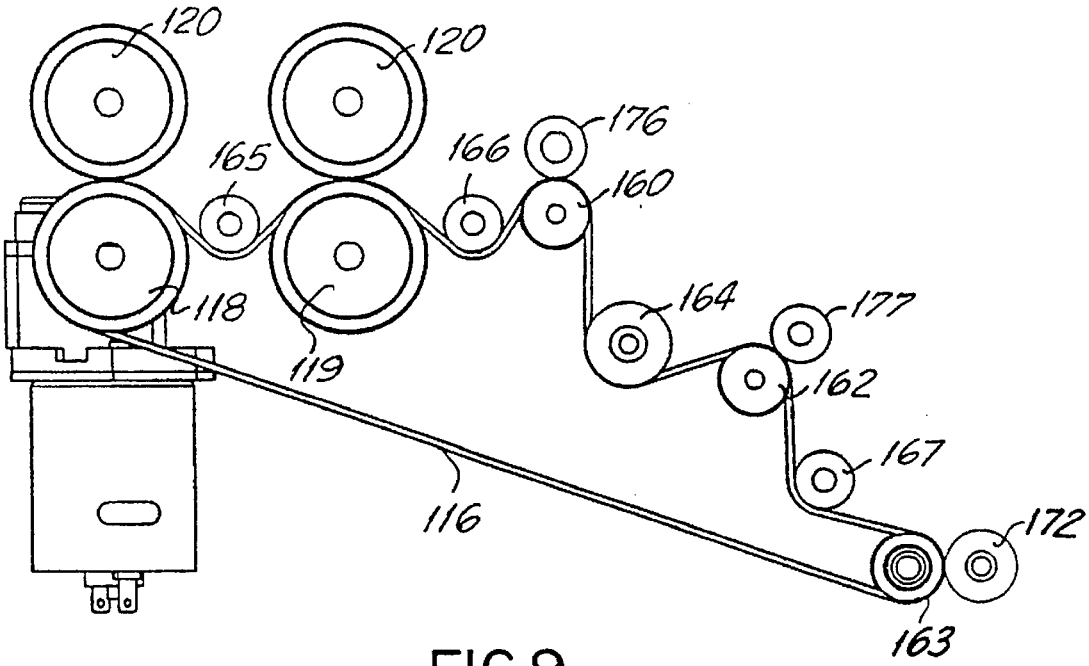
FIG. 9 illustrates a second alternate pulley/belt arrangement.
Figure 10:
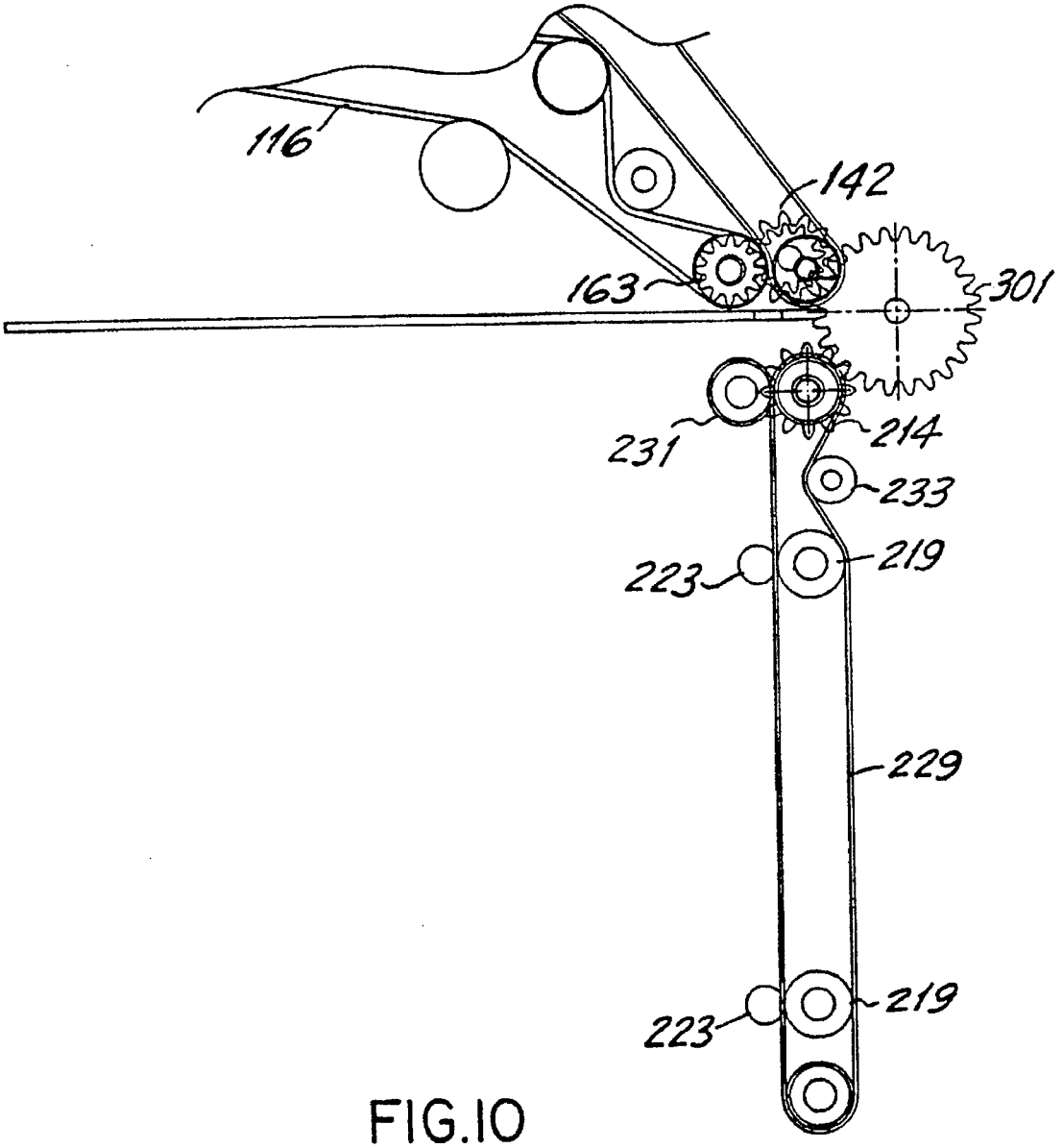
FIG. 10 illustrates details of a gearing arrangement suitable for use in conjunction with the apparatus of FIG. 1 illustrating the arrangement with the gears meshed.
Figure 11:
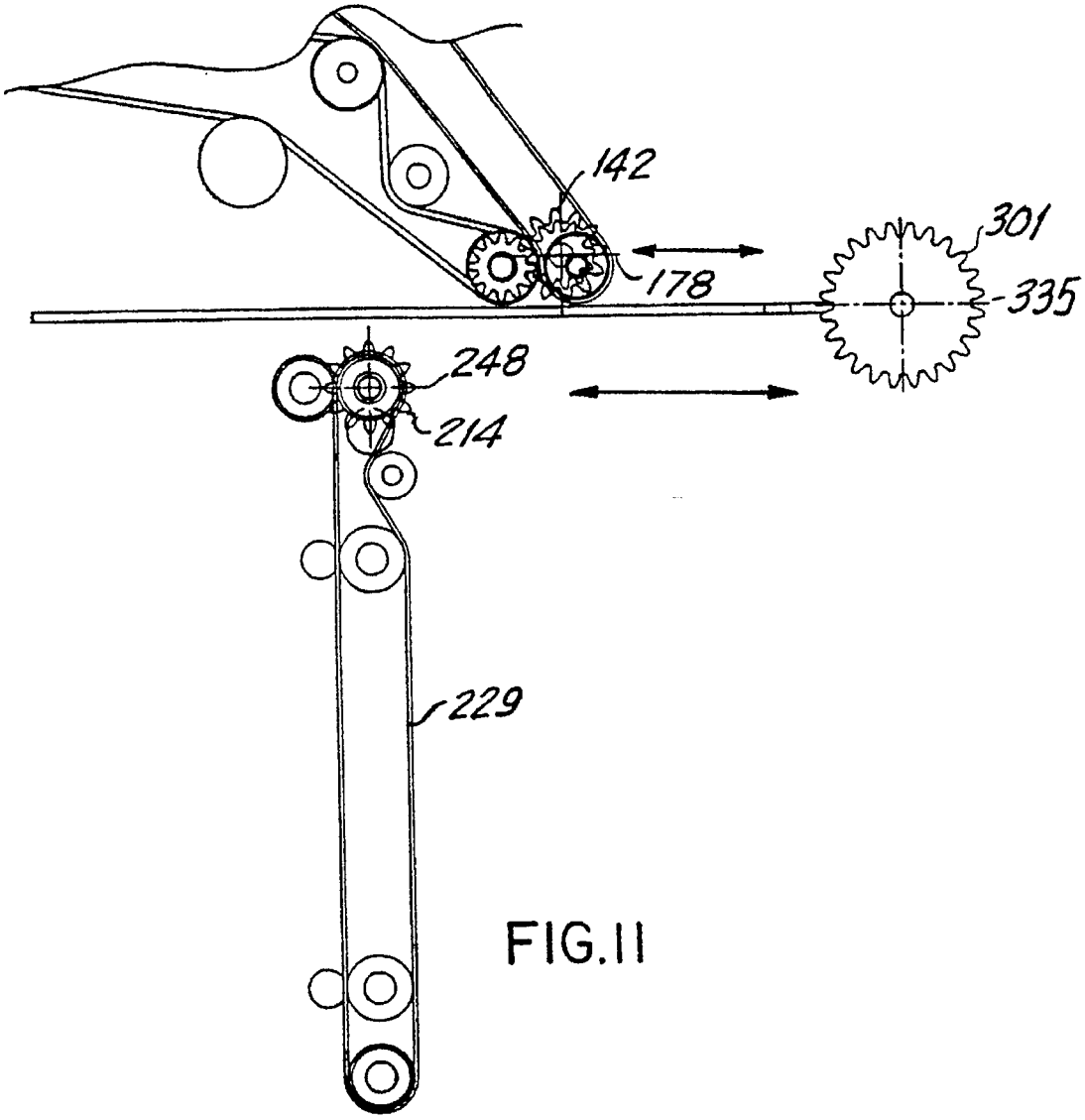
FIG. 11 illustrates the gear arrangement of FIG. 10 with the gears in a pre-engaged position.
Figure 12:
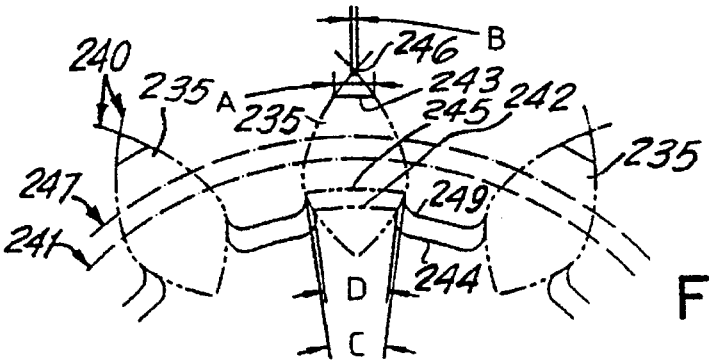
FIG. 12 is a detailed view of a tooth arrangement suitable for use in conjunction with the gears of the gear arrangement of FIGS. 10 and 11.

FIGS. 7–9 illustrate in greater detail how currency is transported from the currency entryway or insert slot 101 to the pre-stacking position 201. FIGS. 10–12 illustrate details of a presently preferred gearing arrangement used in conjunction with the transport arrangements of FIGS. 7–9. FIGS. 13–16 further illustrate the presently preferred mechanism for pushing that currency from the pre-stacking position 201 into the cassette 200 where it is stacked with a plurality of other pieces of currency 215.

The currency validator and transport unit 100 includes a currency validator portion including the recognition assembly 126 and the portion of the transport base 125 under the recognition assembly 126, as shown in FIG. 4, which define a first part of the bill passageway 103. Disposed on either side of the bill passageway 103 are two continuous tractor belts 116 which are supported by parallel front rollers 118 and 119. The front rollers 118 are operably connected via a series of gears (not shown) to a motor 105. The motor controlled belts 116 act to advance a bill through the passageway 103 in a forward direction (from left to right in FIG. 7). The motor 105 is reversible so that it can drive the belts 116 in an opposite direction, reversing the direction of travel of the bill.

In the presently preferred embodiment shown in FIG. 7, the tractor belts 116 drive additional currency contact rollers 160 and 162. Belt positioning rollers 165, 166, and 167 are also driven by the tractor belts 116 and serve to limit the contact area of the tractor belts 116 by the transported currency to the currency contact rollers 160 and 162. This benefit of this arrangement is best seen in FIG. 4 as the transport base 125 can be made of molded plastic. This arrangement allows for maximum structural integrity of the transport base 125 as any openings therein, such as openings 128, may be minimized. Referring to FIG. 7, the tractor belts 116 further drive a driving roller 163. The tension of belt 116 is maintained through spring force (not shown) on a tension roller 164.

Utilizing the presently preferred drive arrangement of FIG. 7, currency enters unit 10 at entry 101, and is driven by rollers 118 and belts 116 through the currency validator and transport unit 100. The currency is pinched between the traction belts 116, at rollers 118 and 119, by the support rollers 120. Secondary belts 136 continue to transport the currency, pinching it between them and the rollers 160, 162. The currency is driven between tractor belts 116 and 136 out of the transport unit 100, through the slot or opening 227 (shown in FIG. 5) in the top of the cassette 200.

The front end of the currency is then pinched between rollers 231 and belts 229 of the cassette 200 and driven into the prestacking position 201. In this presently preferred embodiment, only a single drive motor, the motor 105, is employed to transport currency from entry 101 to prestacking position 201. This arrangement eliminates timing and jamming problems inherent when two separate drive motors are employed.

Alternate embodiments of the drive belts and rollers are shown in FIGS. 8 and 9. In FIG. 9, the serpentine arrangement of the tractor belts as shown in FIG. 7 is eliminated. This FIG. 8 arrangement provides for continuous belt contact of the currency through the validator and transport unit 100. In this configuration, a single support roller 175 is sufficient. Belt tension would still be maintained by a spring (not shown) biased roller 164. This arrangement is particularly advantageous in cases where the transport base 125 does not require a molded plastic surface, or the length of bill travel is such as to cause no compromise to the structural integrity of the base 125 with large openings 128.

The configuration in FIG. 9 is a simplification of the configuration described in FIG. 7, in that the secondary belts 136 are eliminated. Spring (not shown) biased rollers 176 and 177 are positioned to ensure that currency to be transported is pinched between these rollers and the tractor belts 116. This arrangement is advantageous when the total distance the currency must travel is short or the angular displacement of the currency is minimal.

Driving roller 163 is attached to and includes a driving gear portion as shown in FIGS. 10 and 11, to be discussed further below. The roller portion of 163 drives secondary belts 136. The secondary belts 136 in turn drive rollers 171 and 172. Tension on the secondary belts 136 is provided by roller 173, which is spring (not shown) biased.

Referring to FIG. 10, the drive gear attached to driving roller 163 drives an interface gear 142 which is a compound gear. The second part of this compound gear meshes with a transfer gear 301 mounted in the chassis 300. This transfer gear 301 meshes with the gear 214 in the cassette 200. The gear 214 drives the belts 229 which in turn drive rollers 219 and 231. Belts 229 are held in tension by spherical ball rollers 223 which are spring (not shown) biased.

FIGS. 10 and 11 illustrate the. engagement of the gears between the transport unit 100 and the chassis 300 as well as between the cassette 200 and the chassis 300. FIG. 10 illustrates the relationship between the interface gear 142 in the transport unit 100 and the transfer gear 301 in the chassis 300. Additionally, the relationship between the gear 214 in the cassette 200 and the transfer gear 301 is shown. In normal operation, the driving roller/gear assembly 163 is driven by tractor belts 116 in a clockwise direction. This gear drives the compound interface gear 142 in a counterclockwise direction. The second portion of compound interface gear 142, shown as having the larger diameter, drives the transfer gear 301 in chassis 300 in a clockwise direction. This transfer gear 301 in turn drives the gear 214 in the cassette 200 in a counterclockwise direction. Currency is therefore consistently being driven in the forward direction. When operating in the reverse direction, all the belts and gears are moving in directions opposite that described above.

FIG. 11 illustrates the relationship between the drive components in each of the three major subassemblies 100, 200 and 300 before they are engaged. The engaging gear 142 in the transport unit 100 and the engaging gear 214 in the cassette 200 are identical. The method of engagement of each of these to the fixed transfer gear 301 in the chassis 300 is also identical. The self aligning nature of the gear engagement between the slidably mounted components of the transport unit 100 and the cassette 200, are best understood by referring to FIG. 12, which illustrates a suitable tooth 235 common to the engaging gears 142 and 214.

It is well understood in the design of gears that the shape of a gear tooth of this type follows an involute curve 240. This theoretical profile ensures the correct engagement with the mating gear teeth. It is also well understood in the design of gears to use a nominal operating pitch 241 which is essentially the center of the operational area of the gear tooth 235. In FIG. 12, the nominal operating pitch 241 results in an operating area of the gear tooth 235 which is bound by position 242 on the inner surface of the tooth 235 and by position 243 on the outer surface of the tooth 235. The depth of the tooth or inside diameter 244 is set to ensure clearance to position 242. In this normal tooth case, the strength of the tooth is primarily determined by the width of the tooth 235 at the inner diameter 244, and is shown in FIG. 12 as "D". The width of the tooth 235 at the outer diameter 243 is shown as "A".

In the preferred embodiment, an oversized operating pitch 247 is used. In this case the operating area of the gear tooth 235 would be bound by position 245 on the inner surface of the tooth and by position 246 on the outer surface of the tooth 235. The depth of the tooth or inside diameter 249 is again set to ensure clearance to position 245. When using the oversized pitch 247, the inner diameter 249 results in a width shown in FIG. 12 as "C". The outer diameter 246 width of tooth 235 is shown as "B".

Comparing the critical dimensions when using the oversized operating pitch 247 relative to the normal operating pitch 241, two key advantages are gained. The gear tooth 235 has a larger root thickness, shown as the difference between "C" and "D". The increased root thickness provides greater tooth strength. The outer diameter tooth width is smaller, shown as the difference between "A" and "B". It is this width that is critical to minimizing the potential interference when engaging with the mating transfer gear 301.

Referring again to FIG. 11, the center line 335 of the transfer gear 301 is offset from the center line 178 of the engaging gear 142 in the transport 100. The center line 248 of the engaging gear 214 in the cassette 200 is similarly offset from the center line 335 of the transfer gear 301. As the engaging gears 142 and 214 mesh with the transfer gear 301, the force of the initial tooth engagement is indirect due to the offset center lines. This tends to avoid a head on tooth to tooth clash. The force of the engaging teeth will cause the transfer gear 301 tooth to rotate to allow engagement. The ability of the teeth to interfere on engagement is limited to the tooth width at the outer diameter of each of these gears. As described above, using an oversized operating pitch reduces this width, minimizing the potential for interference. Further, neither gear 301 nor gear 214 has a substantial load. As a result, unless two teeth meet head on head while unit 100 or 200 is inserted into chassis 300, the gears 301 and 214 can turn to a position of proper alignment without requiring an excessive insertion force. Ease of replacement of unit 100 or cassette 200 is thereby substantially facilitated.

Figure 13:
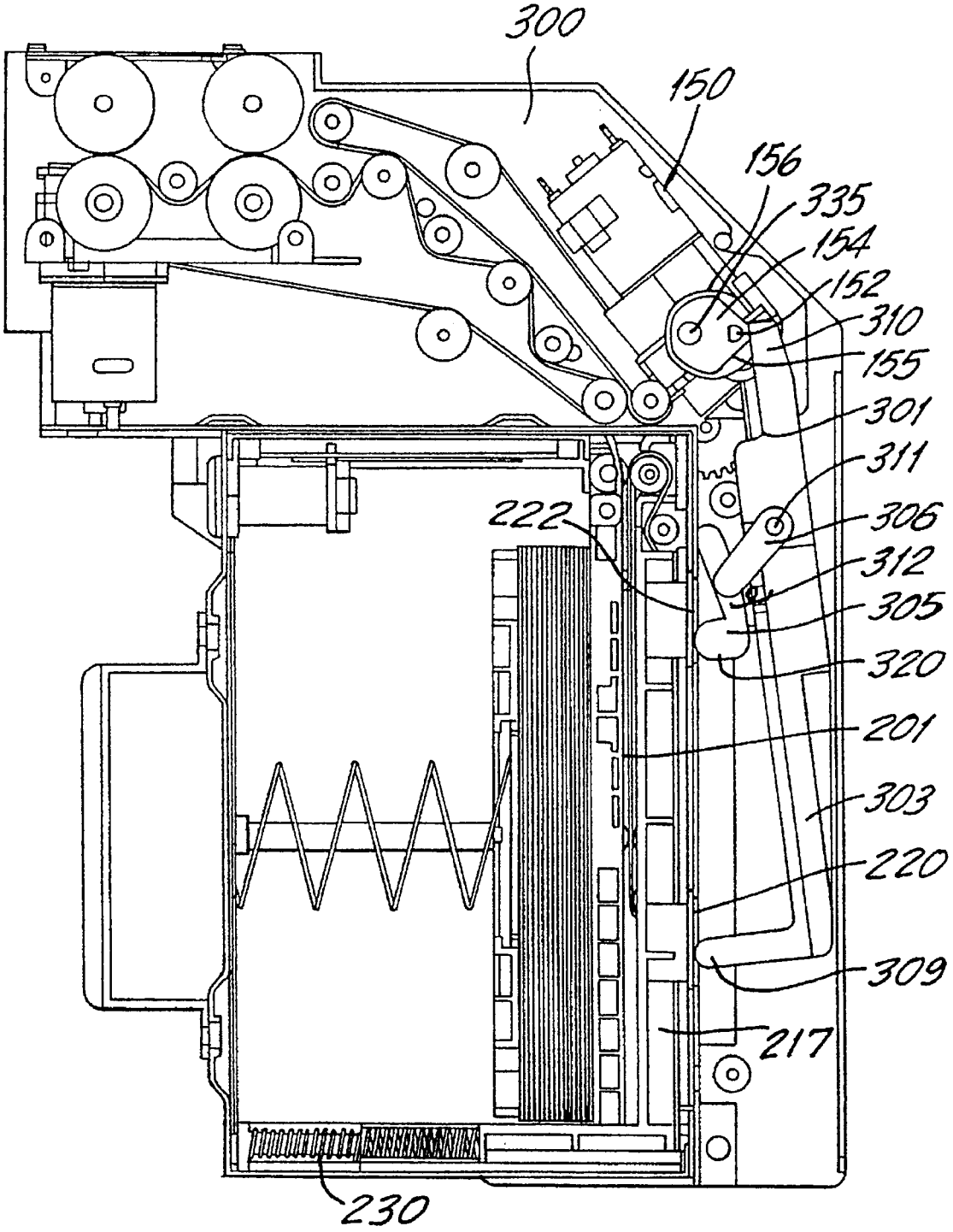
FIG. 13 is a first side view illustrating the apparatus of FIG. 1 with the actuating fork in its home position and the interrupt arm in the cassette present position.
Figure 14:
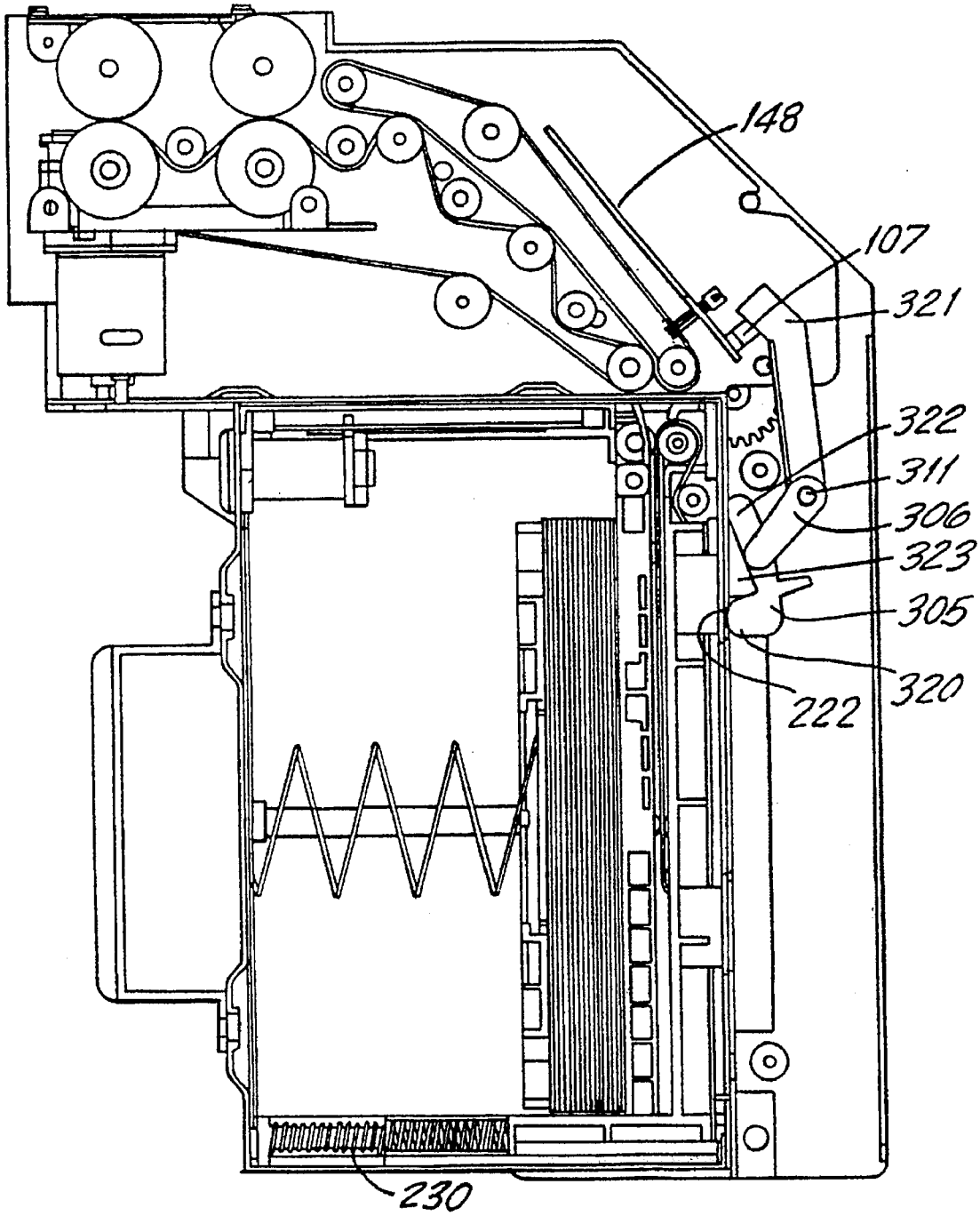
FIG. 14 is a second side view of the apparatus of FIG. 1 absent the actuating fork which illustrates the position of the interrupt arm in the cassette present position.
Figure 15:
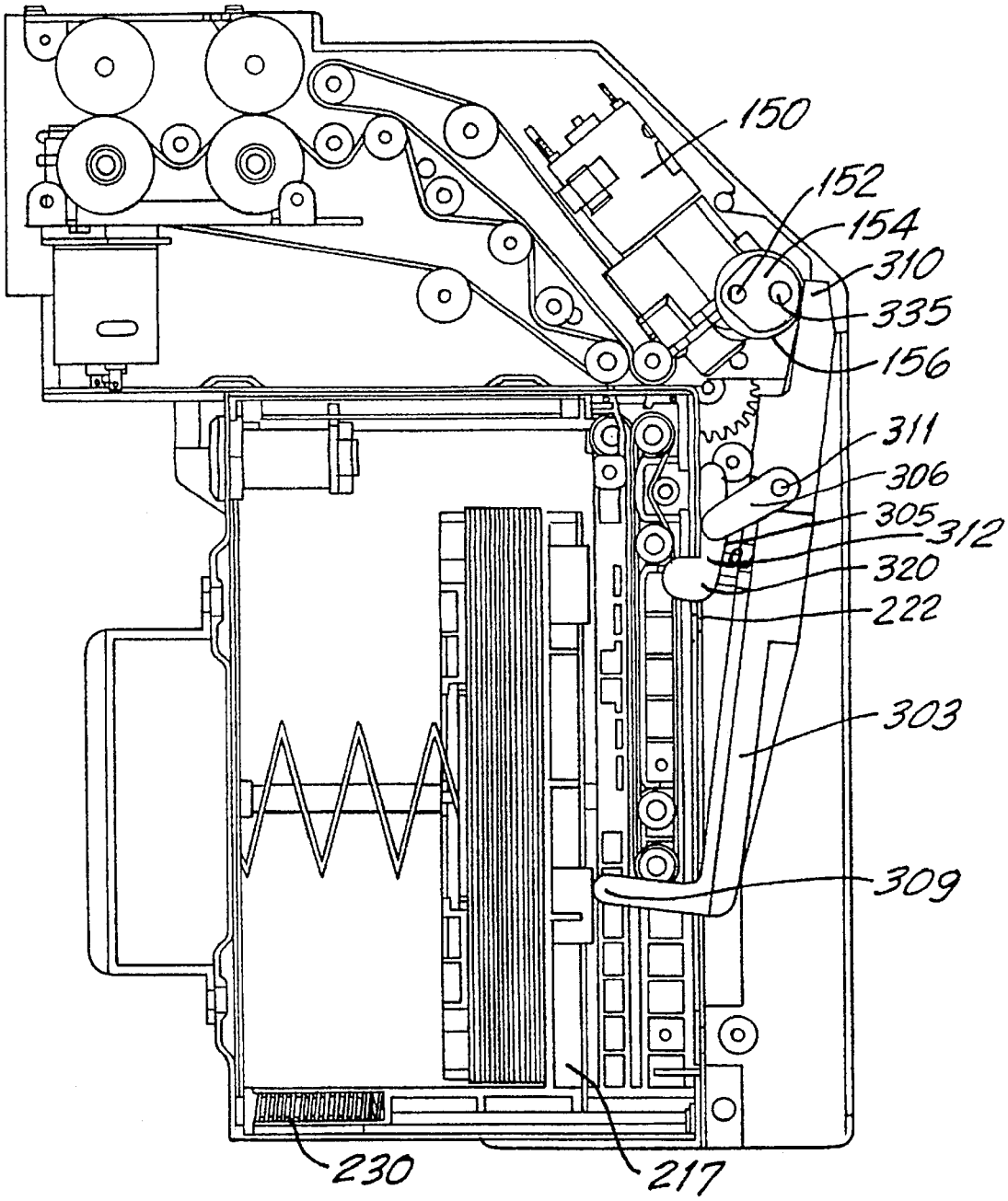
FIG. 15 is a third side view of the apparatus of FIG. 1 illustrating the actuating fork in its away from home or away position and the interrupt arm in the cassette absent position.
Figure 16:
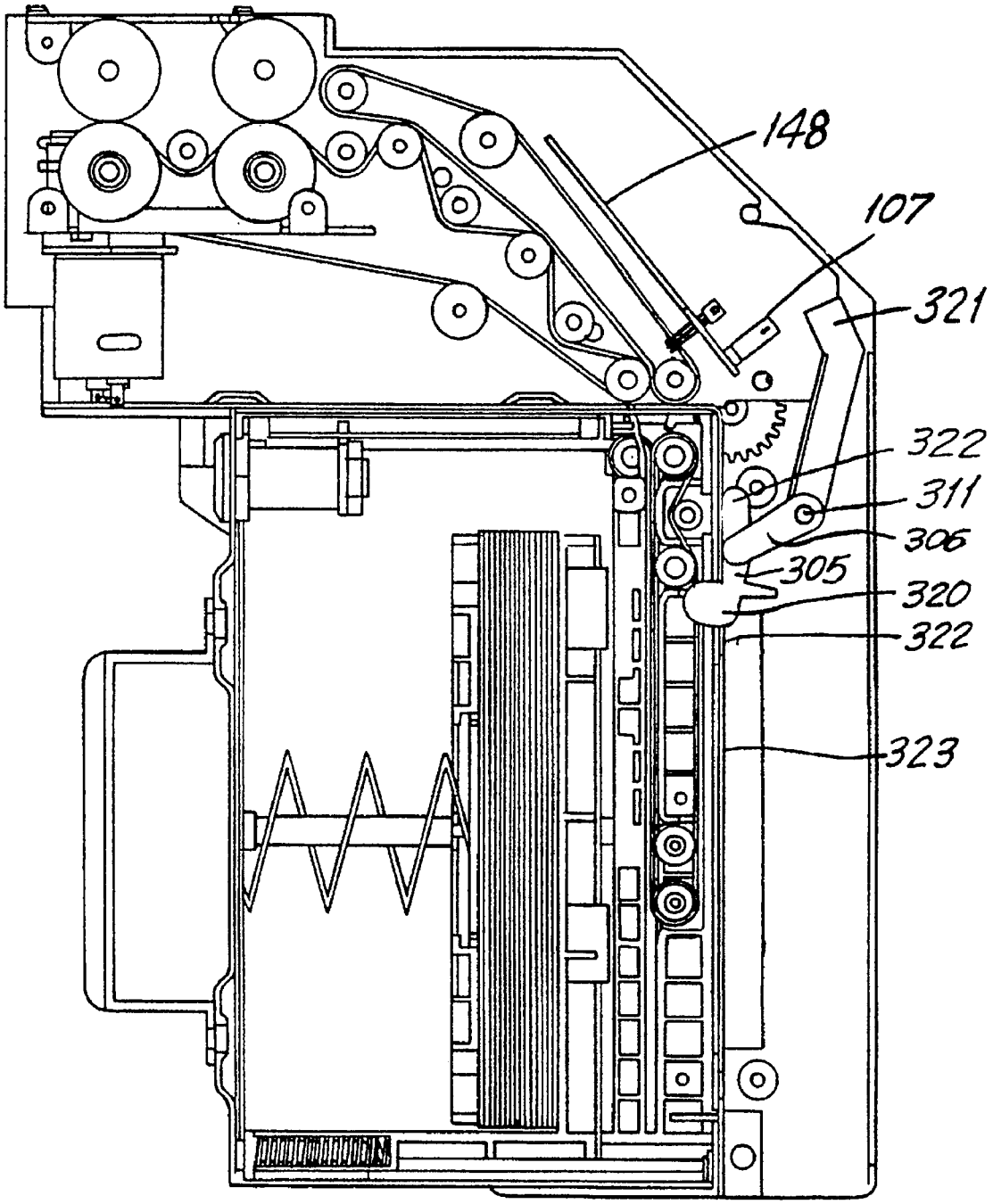
FIG. 16 is a fourth side view of the apparatus of FIG. 1 absent the actuating fork which illustrates the position of the interrupt arm in the cassette absent position.

Turning to the details of stacking and sensing, FIGS. 13–16 are further side views of the internal configuration of overall unit 10 of FIG. 1. In particular, these FIGS. 13–16 illustrate how currency is pushed from the prestacking position 201 into the storage position with other stored currency 215. These figures also illustrate how stacking is sensed and how cassette presence or absence is reliably sensed. FIGS. 13 and 15 are side views which show an actuating fork 303 and part of an interrupt arm 305 on one side of a motor 150. FIGS. 14 and 16 are side views with the actuating fork 303 and motor 150 removed to show an upper part of the interrupt arm 305 on the other side of the motor 150.

The actuating fork 303 is mounted about a pivot 311 and is spring biased by a spring 312 into a home position, as illustrated in FIG. 13. An end 309 of the actuating fork 303 passes through an opening 220 in the outer and inner boxes of the cassette 200 to engage and advance the pusher plate 217, thereby causing a piece of currency in the prestacking position 201 to be stacked.

The interrupt arm 305 is pivotally mounted about the same pivot 311 as the actuating fork 303 and is spring biased relative to the actuating fork 303 by spring 312 as shown. As shown in FIGS. 14 and 15, a first end 320 of the interrupt arm 305 passes through a second opening 222 in the outer and inner boxes of the cassette 200. A second end 321 of the interrupt arm 305, which is behind the actuating fork 303 of FIG. 13, is positioned adjacent a cassette home or present switch 107 when the interrupt arm 305 is in a home position, as best illustrated in FIG. 14. The first end 320 and the second end 321 of the interrupt arm 305 are connected by a cross-piece 306. The first end 320, second end 321 and cross-piece 306 are preferably molded in one piece. Returning to FIG. 13, as the actuating fork 303 pushes the pusher plate 217, the spring 312 pushes on the portion of the interrupt arm 305 below the cross-piece 306, causing the interrupt arm 305 to rotate about the pivot point 311. As a result, the first end 320 of the interrupt arm 305 protrudes through the second opening 222 and the second end 321 of interrupt arm 305 moves away from the cassette home or present switch 107, as best seen in FIG. 16, allowing the validator and transport unit 100 to sense each time the pusher plate 217 operates to stack a piece of currency into cassette 200.

Similarly, when the cassette 200 is removed from the mounting chassis 300, the pressure of the pusher plate 217 upon first end 320 is removed, the spring 318 causes the interrupt arm 305 to rotate clockwise about pivot point 311, and the second end 321 again moves away from the cassette home or present switch 107, as shown in FIG. 16. The unit 100 can thereby sense each time the cassette 200 is removed. Similarly, each time the cassette 200 is placed in the chassis 300 it can be sensed. No electrical or electronic components are required in the cassette 200 to do this sensing. Similarly no electrical or electronic interconnections between the cassette 200 and the unit 100 are required.

The interrupt arm 305 will be prevented from pivoting further around pivot 311 as surface 322 rests on the chassis surface 323. The force of spring 312 which is attached between the interrupt arm 305 and the actuating fork 303 is sufficient to keep the actuating fork 303 in its home position shown in FIG. 13.

The actuating fork 303 and interrupt arm 305 are preferably driven as follows. The motor 150 as shown in FIGS. 13 and 15 includes a gear train which drives a shaft 152. A cam 154 is mounted on the shaft 152, and the surface of cam 154 drives the actuating fork 303 as a second end 310 of fork 303 rides on the camming surface of the cam 154. The cam surface of the cam 154 is selected in known fashion.

In a preferred embodiment, that surface is selected to maintain the fork 303 in its home position as illustrated in FIG. 13 over a wide range of cam positions. As the cam 154 rotates through a region of essentially constant radius 155, no motion is imparted to fork 303. As cam 154 is rotated through a region of increasing radius 156, the cam 154 abuts the second end 310 and the actuating fork 303 begins to push the pusher plate 217 which in turn pushes the currency through the window 224, best shown in FIG. 6, and into the storage portion of the cassette 200. As the cam 154 continues to rotate, the first end 309 of the fork 303 is fully extended through opening 220 to its away from home or away position as illustrated in FIG. 15.

Then, as cam 154 returns to its home position, as in FIG. 13, the force of the spring 312 causes the fork 303 to quickly return to its home position. The home position of the fork 303 may be sensed by sensing the position of cam 154 in a known fashion. For example, a magnet 335 can be embedded in the cam surface 156 and a Hall effect sensor (not shown) can be mounted on a printed circuit board (PCB) 148 in the bill validation and transport unit 100 to sense the proximity of the magnet, as described in column 7 of U.S. Pat. No. 4,722,519. U.S. Pat. No. 4,722,519 is assigned to the assignee of the present invention and is incorporated by reference herein. Another way of sensing the home position of cam 154 is taught in FIG. 9 and the associated text of U.S. Pat. No. 4,765,607, also assigned to the assignee of the present invention and incorporated by reference herein. The combination of the information as to the position of the cam 154 and the position of the second end 321 of the interrupt arm 305 allows the ready determination of the presence or absence of cassette 200 as well as the detection and counting of each stacking operation by control electronics, such as a microprocessor.

In FIG. 15, both the interrupt arm 305 and the actuating fork 303 are in their away position. The interrupt arm 305 will reach its away position sooner than the actuating fork 303. As the actuating fork 303 continues to push the pusher plate 217, the spring between the interrupt arm 305 and actuator fork 303 compresses. Any attempt to cheat the unit by blocking the interrupt arm 305 without using a cassette, will result in easy detection. Firstly, the actuator fork 303 will be prevented from moving to its fully away position by the interrupt arm 305. The motor 150 which drives the actuator fork 303 will be prevented from doing so, and will stall. This stalling will be detected by the control electronics when the motor fails to complete a cycle in the expected time. Secondly, the expected cycling of the interrupt arm 305 would not follow the expected timing which would normally cause a presence switch 107 which is mounted on the printed circuit board 148 to sense the absence of the second end 321 of the interrupt arm 305. The control electronics would disable currency acceptance in a known fashion if this improper cycling is detected.

I claim:

1. A removable currency cassette comprising:

an outer security frame;

an inner assembly dimensioned so that it can be slidably inserted into or removed from the outer security frame, said inner assembly including a pusher plate proximate one side of the inner assembly for pushing currency onto a stack of currency within the inner assembly, a currency transport roller assembly proximate the pusher plate for conveying currency into a position proximate the pusher plate and a spring biased pressure plate within the inner assembly opposite the pusher plate for biasing the stack of currency within the inner assembly;

means for releasably connecting the inner assembly to the outer security frame; and means for locking the removable currency cassette.

2. The apparatus of claim 1 wherein the outer security frame is an open-topped metal shell.

3. The apparatus of claim 2 wherein the inner assembly comprises four connected side walls each having a top, a metal lid hingedly connected to the top of one side wall, and a metal mounting surface on at least one side of the inner assembly, designed to be mounted to the open-topped metal shell of the security frame.

4. The apparatus of claim 3 wherein the means for locking the removable currency cassette comprises at least one lock on the outer frame, the lock having a hasp which engages a slot in the metal lid to lock said lid closed.

5. The apparatus of claim 4 wherein the lock can be screwed into engagement with the slot and when the lock is open so that its hasp does not engage the metal lid, the lid can be opened and the lock can be unscrewed and removed.

6. A currency validator and stacker comprising:

a removable bill validator and transport unit;

a lockable removable cassette; and a mounting chassis wherein the improvement comprises a box within a box construction for the lockable removable cassette comprising:

an outer security frame;

an inner assembly dimensioned so that it can be slidably inserted into or removed from the outer security frame, said inner assembly including a pusher plate proximate one side of the inner assembly for pushing currency onto a stack of currency within the inner assembly, a currency transport roller assembly proximate the pusher plate for conveying currency into a position proximate the pusher plate and a spring biased pressure plate within the inner assembly for biasing currency within the inner assembly towards the one side of the inner assembly;

means for releasably connecting the inner assembly to the outer security frame; and means for locking the removable currency cassette.

7. The apparatus of claim 6 wherein the outer security frame is an open-topped metal shell.

8. The apparatus of claim 7 wherein the inner assembly comprises four connected side walls each having a top, a metal lid hingedly connected to the top of one side wall, and a metal mounting surface on at least one side of the inner assembly designed to be mounted to the open-topped metal shell of the security frame.

9. The apparatus of claim 8 wherein the means for locking the removable currency cassette comprises at least one lock on the outer frame, the lock having a hasp which engages a slot in the metal lid to lock said lid closed.

10. The apparatus of claim 9 wherein the lock can be screwed into engagement with the slot and when the lock is open so that its hasp does not engage the metal lid, the lid can be opened and the lock can be unscrewed and removed.

11. A removable currency cassette for use on a currency handling device comprising:

an outer security frame;

an inner assembly for storing currency dimensioned so that it can be slidably inserted into or removed from the outer frame;

first means for releasably connecting the inner assembly to the outer security frame; and second means for locking the removable currency cassette;

wherein the locking means is separate from the first means and must be unlocked to gain access to the first means and to remove the inner assembly from the outer security frame.

12. The removable currency cassette of claim 11 further comprising a lid hingedly connected to the cassette, wherein the lid must be opened to gain access to the first means.

13. A removable currency cassette for use on a currency handling device comprising:

an outer security frame comprising an open topped shell;

an inner assembly for storing currency, comprising four connected side walls each having a top, and a lid hingedly connected to the top of one side, the lid selectively closing the top of the inner assembly, wherein the inner assembly is dimensioned so that it can be slidably inserted into or removed from the outer frame;

means for releasably connecting the inner assembly to the outer security frame; and means for locking the removable currency cassette;

wherein the locking means must be unlocked to remove the inner assembly from the outer security frame.

14. The removable currency cassette of claim 13 further comprising a mounting surface on at least one side of the inner assembly designed to be mounted to the open topped shell of the security frame.

* * * * *